US005548844A

United States Patent [19]

Ceresia

[11] Patent Number: 5,548,844

[45] Date of Patent: Aug. 27, 1996

[54] PROTECTIVE GLOVE

[76] Inventor: Norma J. Ceresia, 808 Beech Dr., Niskayuna, N.Y. 12309

[21] Appl. No.: 536,690

[22] Filed: Sep. 29, 1995

[51] Int. Cl.[6] ..... A41D 13/10; A41D 19/00

[52] U.S. Cl. ..... 2/161.7; 2/164; 2/168; 2/161.6

[58] Field of Search ..... 2/164, 161.7, 168, 2/167, 161.6, 16

[56] References Cited

U.S. PATENT DOCUMENTS

| | | | |
|---|---|---|---|
| 723,348 | 3/1903 | Wilkens | 2/164 |
| 1,279,855 | 9/1918 | Garvey | 2/168 |
| 2,429,122 | 10/1947 | Crowley | 154/110 |
| 2,446,921 | 8/1948 | Grant | 2/168 |
| 4,095,292 | 6/1978 | Klein | 2/168 |
| 4,416,026 | 11/1983 | Smith | 2/161 R |
| 4,454,611 | 6/1984 | Tschirch et al. | 2/161 R |
| 4,536,890 | 8/1985 | Barnett et al. | 2/164 |
| 4,545,841 | 10/1985 | Jackrel | 156/290 |
| 4,679,257 | 7/1987 | Town | 2/164 |
| 4,748,693 | 6/1988 | Shinn | 2/164 |
| 4,771,482 | 9/1988 | Shlenker | 2/168 |
| 4,847,918 | 7/1989 | Sturm | 2/161 R |
| 4,881,277 | 11/1989 | Hogle | 2/169 |
| 4,901,372 | 2/1990 | Pierce | 2/167 |
| 4,942,626 | 7/1990 | Stern et al. | 2/161 R |
| 4,947,486 | 8/1990 | Hsuih | 264/164 |
| 4,964,174 | 10/1990 | Martin | 2/161 R |
| 4,995,119 | 2/1991 | Codkind | 2/163 |
| 5,020,162 | 6/1991 | Kersten et al. | 2/164 |
| 5,317,759 | 6/1994 | Pierce | 2/161.7 |
| 5,349,705 | 9/1994 | Ragan | 2/161.6 |

*Primary Examiner*—Amy B. Vanatta
*Attorney, Agent, or Firm*—Heslin & Rothenberg, P.C.

[57] ABSTRACT

A protective glove for improving tactile sensitivity between a wearer's hand and a selected object includes a plurality of finger stalls extending away from the dorsal and palmar surfaces of the glove. The protective glove has an outer glove layer and an inner glove layer attached to the outer glove layer within the outer glove layer, the outer and inner glove layers having inner and outer surfaces. A plurality of elongated adhesive members extend between the inner and outer glove layers and secure the inner surface of the outer glove layer and the outer surface of the inner glove layer. A hollow channel is formed between a pair of successive strips of the plurality of strips. At least one opening may be selectively formed on the inner glove layer so as to expose a corresponding portion of the inner surface of the outer glove layer through the at least one opening.

18 Claims, 3 Drawing Sheets

PROTECTIVE GLOVE

BACKGROUND OF THE INVENTION

1. Technical Field

The present invention generally relates to protective gloves. More particularly, the present invention relates to protective gloves having a high degree of tactile sensitivity and comfort.

2. Background Information

Many protective gloves are available for protecting and shielding a wearer's hands from various external hazards, including sharp items, high temperatures and toxic chemicals. Notably, the need for protective gloves is critical in the medical industry where life threatening diseases, such as AIDS, may be spread by a puncture wound caused by a syringe. Therefore, in the medical industry, superior protective gloves are continually being desired and sought after.

However, a drawback associated with protective gloves having high protective features, especially gloves for use in the medical industry, is their reduced tactile sensitivity. Another problem is that protective gloves often inhibit movement of the wearer's hands and reduce the comfort of the user. While protective gloves are often needed in radically different environments—in cold weather rescue situations and as surgical gloves during surgery—there are no known gloves which perform well in both of these different environments. In an ideal situation, protective gloves should protect the wearer's hands from numerous external hazards and at the same time, not limit the tactile sensitivity and dexterity of the user. Also, the gloves should provide warmth and added comfort to the user in cold environments. Finally, the gloves should have high absorbency characteristics for improving comfort.

Thus, a need exists for a protective glove for various environments which includes superior protective characteristics and at the same time, promotes a high degree of tactile sensitivity and comfort. The structure of the present invention contains a solution to the aforementioned problems.

SUMMARY OF THE INVENTION

Briefly, the present invention satisfies this need and overcomes the shortcomings of the prior art through the provision of a protective glove for facilitating tactile sensitivity, which includes an outer glove layer having an inner surface and an outer surface; an inner glove layer being adapted for attachment within the outer glove layer, the inner glove layer having an inner surface and an outer surface; a plurality of strips extending between and attaching the inner surface of the outer glove layer and the outer surface of the inner glove layer; a hollow channel formed between a pair of successive strips of the plurality of strips for facilitating air passage therethrough; and the inner and outer glove layers being fabricated from a material which facilitates tactile sensitivity.

Preferably, the protective glove of the present invention includes a plurality of openings selectively formed on the inner glove layer so as to expose corresponding portions of the inner surface of the outer glove layer through the plurality of openings. Each of the plurality of openings may form an edge of the inner glove layer, the edge being attached to the inner surface of the outer glove layer.

In the preferred embodiment of the present invention, the plurality of strips extend in a direction substantially parallel to the direction of a thumb stall and a plurality of finger stalls of the protective glove which extend away from palmar and dorsal portions of the protective glove. Alternatively, the plurality of strips may extend in a direction substantially orthoganol to the direction of the stalls. The hollow channel formed between the pair of successive strips has a width which is great enough so as to facilitate mating of the inner surface of the outer glove layer and the outer surface of the inner glove layer during use.

It is therefore a primary object of the present invention to provide a glove having improved protective characteristics, which can be used in a variety of different environments.

It is an object of the present invention to provide a glove which provides warmth during cold weather use.

It is another object of the present invention to provide a glove having a high degree of tactile sensitivity and comfort without sacrificing its improved protective characteristics.

It is yet another object of the present invention to provide a glove having high absorbency characteristics.

It is still another object of the present invention to provide a protective glove which includes an air circulation system for improving comfort and tactile sensitivity of the user.

It is yet another object of the present invention to provide a disposable protective glove which is inexpensive to manufacture.

BRIEF DESCRIPTION OF THE DRAWINGS

The subject matter which is regarded as the present invention is particularly pointed out and distinctly claimed in the concluding portion of the specification. The invention, however, both as to organization and method of practice, together with the further objects and advantages thereof, may be best understood by reference to the following detailed description, taken in conjunction with the accompanying drawings, in which:

DETAILED DESCRIPTION OF THE INVENTION

Figure 1:
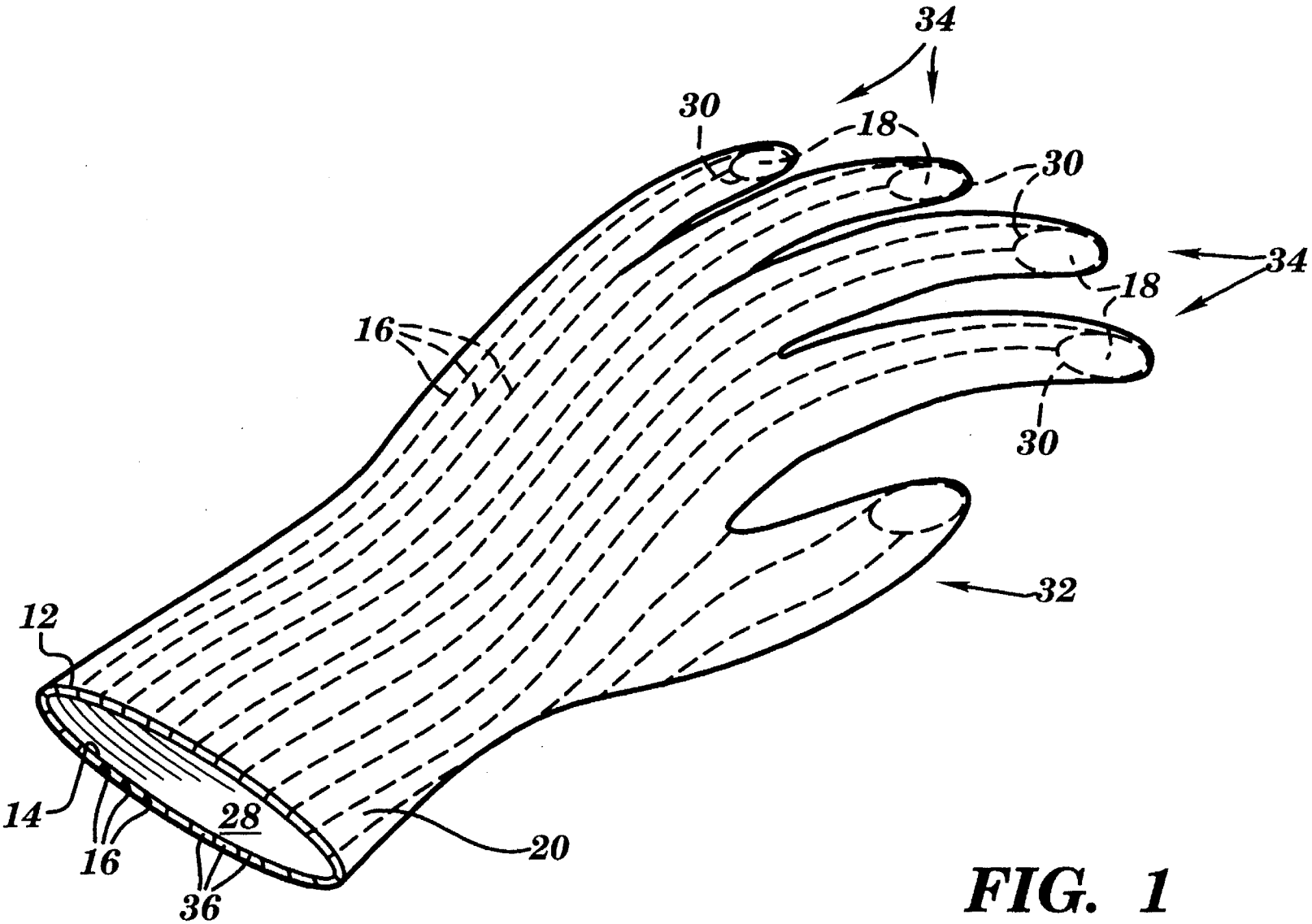
FIG. 1 is a perspective view of a protective glove constructed in accordance with the principles of the present invention, illustrating a dorsal portion of left-handed glove, and in phantom, a plurality of adhesive strips extending between an outer glove layer and an inner glove layer.
Figure 2:
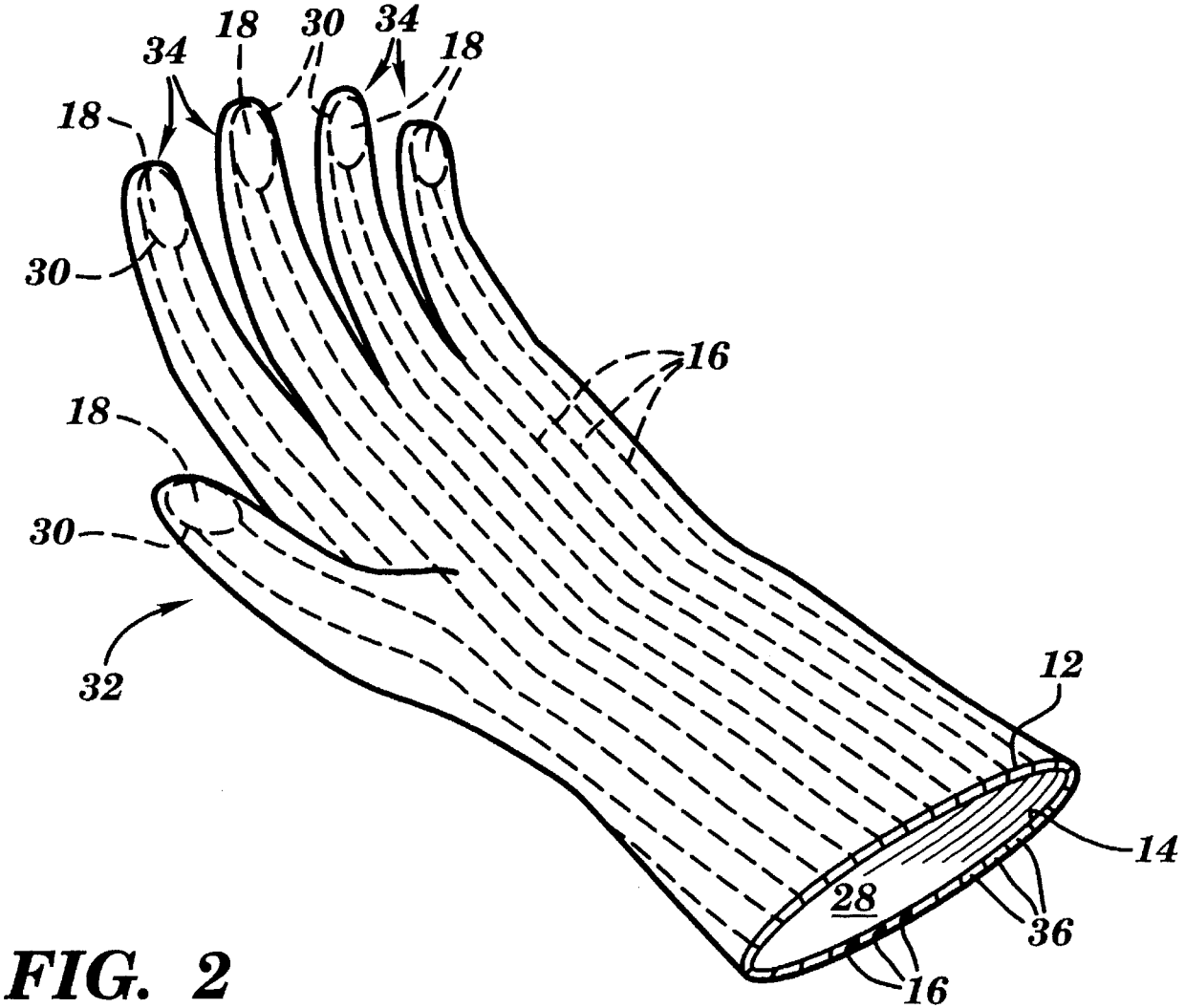
FIG. 2 is a perspective view of the protective glove of FIG. 1, showing a palmar portion of the glove constructed in accordance with the principles of the present invention.
Figure 3:
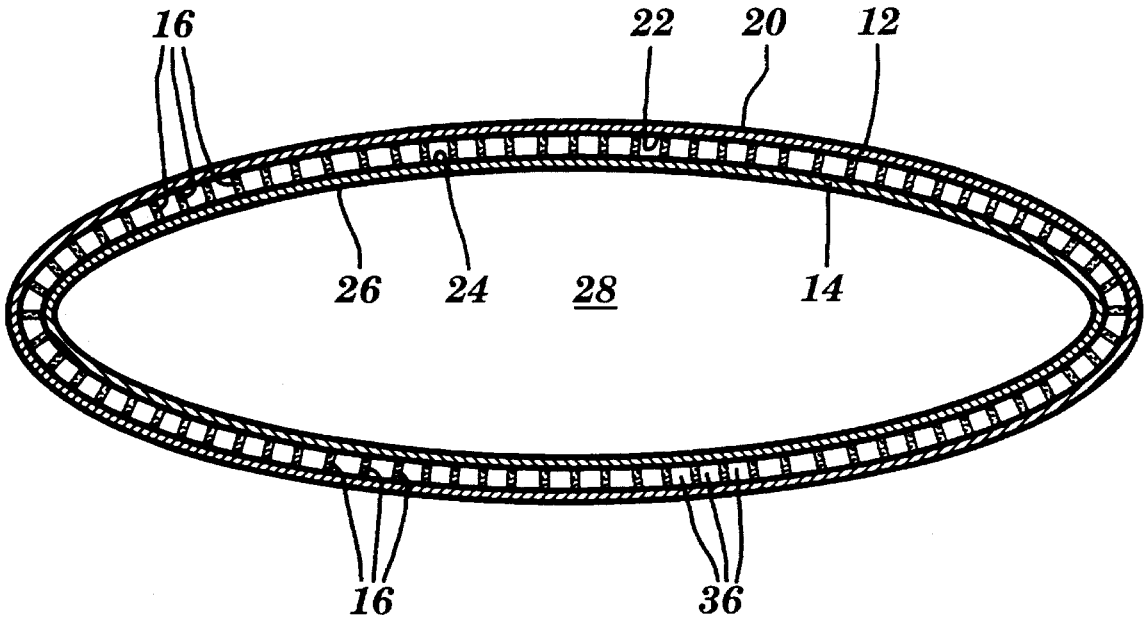
FIG. 3 is a cross-sectional view illustrating in detail the relationship between the inner glove layer and the outer glove layer of the protective glove of the present invention.

It will be readily apparent that the components of the present invention, as generally described and illustrated in the figures, could be arranged and designed in a wide variety of different configurations. Thus, the following detailed description of the protective glove of the present invention, as represented and illustrated in FIGS. 1–3, is not intended to limit the scope of the invention, as claimed, but is merely representative of the presently preferred embodiments of the invention. The presently preferred embodiments of the invention will be best understood by reference to the drawings, where like parts are designated with like numerals.

In reference to the drawings, and more particularly to FIGS. 1 and 2, there is shown in accordance with the principles of the present invention, one embodiment of a protective glove 10, specifically illustrating the dorsal and palmar portions of a left-handed protective glove, respectively. Protective glove 10 includes two glove layers, i.e., an outer glove layer 12 and an inner glove layer 14. The layers may be adhered together through the provision of a plurality of strips 16, which may extend between outer glove layer 12 and inner glove layer 14. To improve the tactile sensitivity or feel for a user of glove 10, a plurality of openings 18 may be selectively formed on inner glove layer 14 so as to expose corresponding portions of outer glove layer 12 through the plurality of openings 18.

As can be seen best in FIG. 3, outer glove layer 12 includes an outer surface 20 and an inner surface 22. Likewise, inner glove layer 14 includes an outer surface 24 and an inner surface 26. Outer surface 20 of outer glove layer 12 is the surface which may contact or touch a selected object during use. Because inner glove layer 14 is adapted for attachment within outer glove layer 12, the size of inner glove layer 14 is preferably slightly smaller than outer glove layer 12.

Both glove layers should be flexible and have strong puncture-resistant characteristics. The flexible outer glove layer 12 is preferably formed of a synthetic material such as latex, vinyl, nitrile, polyethylene, polyurethane, silicone rubber, etc. Outer glove layer 12 preferably acts as the primary barrier for protective glove 10. As for inner glove layer 14, it should be fabricated from a highly absorbent (for reducing moisture buildup) and non-allergenic material, such as cotton, silk, polyester or a blend of like materials depending on the use of the glove. Because outer glove layer 12 acts as the primary barrier for glove 10, the thickness of inner glove layer 14 will preferably be formed smaller than the thickness of outer layer 12. It should be noted, however, that the thickness of both inner glove layer 14 and outer glove layer 12 will be dependent upon the particular use for protective glove 10. For instance, if the intended use of the glove is for cold weather rescues, where warmth is an important ingredient, then the inner and outer glove layers should be thicker than inner and outer glove layers which are intended for surgical use, where sensitivity is most important. Also, protective gloves intended for surgical use should include inner glove layers having better absorbency characteristics than gloves intended for cold weather rescue.

Protective glove 10 may also include a plurality of openings 18 selectively formed on inner glove layer 14 so as to expose corresponding portions of the inner surface 22 of outer glove layer through the plurality of openings 18. Alternatively, openings 18 may be selectively formed on outer glove layer 12 so as to expose corresponding portions of the outer surface 24 of inner glove layer 14 through the plurality of openings. During use, openings 18 permit direct contact between the wearer's skin to inner surface 22 of outer glove layer 12. Each of the openings 18 forms an edge 30 of the inner glove layer 14, which may be physically attached to the inner surface 22 of outer glove layer 12. Any known means of bonding may be employed, including adhesive, chemical and pressure bonding.

As illustrated in FIGS. 1 and 2, openings 18 are preferably formed at the tips of thumb stall 32 and finger stalls 34. If openings 18 are formed at the tips of the stalls, inner layer 14 preferably should cover the ends of the nails of a person's hand so that the nails do not protrude through openings 18. By forming openings 18 at the tips of the stalls, the result is an increased sensitivity at the tip of the thumb and fingers of the user. However, it should be noted that the openings may be formed anywhere on inner glove layer 14, e.g., on the palmar and/or dorsal surfaces, and may be formed in numerous different sizes and shapes to accommodate specific uses for protective glove 10. Any known technique may be used for adhering strips 16 between the inner glove layers, including heat, chemical and pressure bonding.

In order to secure outer glove layer 12 to inner glove layer 14, plurality of strips 16, i.e., adhesive strips, extend between the two glove layers. Each strip 16 acts as an adhesive for adhering outer glove layer 12 to inner glove layer 14. As illustrated in the figures, strips 16 may extend from the edge of opening 28 in a direction substantially parallel to the longitudinal direction of a thumb stall 32 and a plurality of finger stalls 34, terminating at edges 30 of openings 18. However, it should be understood that the present invention is not limited to any specific orientation for strips 16. Instead, the orientation and configuration of strips 16 may vary. For example, strips 16 may be oriented so that they are substantially orthoganol to the longitudinal direction of the thumb and finger stalls.

A hollow channel 36 is formed between each pair of successive strips 16 so as to facilitate the circulation or passage of air therethrough. Each channel 36 may act to dissipate heat and/or reduce moisture buildup in inner glove layer 14, which in turn promotes user comfort and improved sensitivity. The distance separating each pair of strips 16 should be sufficiently large enough to facilitate the mating of inner surface 22 of outer glove layer 12 and outer surface 24 of inner glove layer 14 during use. The greater movement of protective glove 10 during use will cause an air "pumping" action through each channel 36, thereby reducing heat and/or moisture accumulation, as described above.

It may also be desirable to include a third glove layer (not shown) which is formed between inner glove layer 14 and outer glove layer 12. The third glove layer, preferably fabricated from a puncture resistant material, may be secured to the inner surface 22 of outer glove layer 12 and to strips 16. The third glove layer may be partially incorporated at any location on protective glove 10, e.g., only on the dorsal surface.

A user's hand may be inserted into an opening 28 of protective glove 10, i.e., for a comfortable fit into the glove cavity which is defined by inner surface 26 of inner glove layer 14. The edge of opening 28 may be configured such that channels 36 are exposed. Alternatively, it may be desirable to seal or bond outer glove layer 12 to inner glove layer around the periphery of opening 28. In the preferred embodiment, it is desirable that protective glove 10 of the present invention be employed as a disposable glove.

While several aspects of the present invention have been described and depicted herein, alternative aspects may be effected by those skilled in the art to accomplish the same objectives. For example, while openings 18 are illustrated in the drawings at the tips of thumb stall 32 and finger stalls 34, it should be understood that openings 18 may be selectively formed anywhere on the inner glove layer 14 for further improving tactile sensitivity at selected locations. Also, the openings may be formed on outer glove 12. Accordingly, it is intended by the appended claims to cover all such alternative aspects as fall within the true spirit and scope of the invention.

What is claimed:

1. A protective glove for facilitating tactile sensitivity, said protective glove comprising:

an outer glove layer having an inner surface and an outer surface;

an inner glove layer being adapted for attachment within said outer glove layer, said inner glove layer having an inner surface and an outer surface;

a plurality of strips extending between and securing said inner surface of said outer glove layer and said outer surface of said inner glove layer;

a hollow channel formed between a pair of successive strips of said plurality of strips for facilitating air passage therethrough; and said inner and outer glove layers being fabricated from a material which facilitates tactile sensitivity.

2. The protective glove of claim 1, further comprising a plurality of openings selectively formed on said inner glove layer so as to expose corresponding portions of the inner surface of said outer glove layer through said plurality of openings.

3. The protective glove of claim 2, wherein each of said plurality of openings forms an edge of said inner glove layer, said edge being attached to said inner surface of said outer glove layer.

4. The protective glove of claim 1, wherein said glove is configured so as to form dorsal and palmar surfaces with a thumb stall and a plurality of finger stalls extending therefrom, wherein said plurality of strips extend in a direction substantially parallel to the direction of said stalls.

5. The protective glove of claim 1, wherein said glove is configured so as to form dorsal and palmar surfaces with a thumb stall and a plurality of finger stalls extending therefrom, wherein said plurality of strips extend in a direction substantially orthoganol to the direction of said stalls.

6. The protective glove of claim 1, wherein said hollow channel formed between said pair of successive strips has a width which facilitates mating of said inner surface of said outer glove layer and said outer surface of said inner glove layer during use.

7. A protective glove for improving tactile sensitivity between a wearer's hand and a selected object, said glove having a plurality of finger stalls extending away from dorsal and palmar surfaces of said glove, said protective glove comprising:

an outer glove layer and an inner glove layer attached to said outer glove layer within said outer glove layer, said outer and inner glove layers having inner and outer surfaces;

a plurality of elongated adhesive members securing said inner surface of said outer glove layer and said outer surface of said inner glove layer;

a channel formed between a pair of successive elongated adhesive members of said plurality of elongated adhesive members; and at least one opening selectively formed on said inner glove layer so as to expose a corresponding portion of the inner surface of said outer glove layer through said at least one opening.

8. The protective glove of claim 7, wherein said plurality of elongated adhesive members are attached to said outer and inner glove layers in a direction substantially parallel to said plurality of finger stalls.

9. The protective glove of claim 7, wherein a distance separating said pair of successive elongated adhesive members of said plurality of elongated adhesive members is such that said inner surface of said outer glove layer and said outer surface of said inner glove layer are matable through said channel during use.

10. The protective glove of claim 7, wherein a corresponding opening is formed at a tip of said thumb stall and at a tip of each of said plurality of finger stalls.

11. A disposable glove for facilitating the transmission of tactile senses therethrough, said disposable glove comprising:

an outer glove layer having an opening formed on a first end thereof and a thumb stall and a plurality of finger stalls extending away from a second end thereof;

an inner glove layer adapted for being inserted inside of said outer glove layer and adhered to said outer glove layer;

a plurality of elongated adhesive members selectively positioned between said inner and outer glove layers, said plurality of elongated adhesive members for adhering said outer glove layer and an outer surface of said inner glove layer;

a plurality of openings formed on said inner glove layer so that corresponding portions of said outer glove layer are exposed through said plurality of openings for improving tactile sensitivity of a wearer's hand.

12. The protective glove of claim 11, further comprising a channel formed between a pair of successive elongated adhesive members of said plurality of elongated adhesive members for facilitating air passage through said channel.

13. A protective glove for facilitating tactile sensitivity, said protective glove comprising:

an outer glove layer having an inner surface and an outer surface;

an inner glove layer adapted for being inserted within said outer glove layer, said inner glove layer having an inner surface and an outer surface;

a plurality of strips extending between said inner surface of said outer glove layer and said outer surface of said inner glove layer, each of said plurality of strips being attached to at least one of said outer glove layer and said inner glove layer; and a channel formed between a pair of successive strips of said plurality of strips for facilitating air passage therethrough.

14. The protective glove of claim 13, further comprising a plurality of openings selectively formed on said inner glove layer so as to expose corresponding portions of the inner surface of said outer glove layer through said plurality of openings.

15. The protective glove of claim 14, wherein each of said plurality of openings forms an edge of said inner glove layer, said edge being attached to said inner surface of said outer glove layer.

16. The protective glove of claim 13, wherein said channel formed between said pair of successive strips has a width which facilitates mating of said inner surface of said outer glove layer and said outer surface of said inner glove layer during use.

17. The protective glove of claim 13, wherein said glove is configured so as to form dorsal and palmar surfaces with a thumb stall and a plurality of finger stalls extending therefrom, wherein said plurality of strips extend in a direction substantially parallel to the direction of said stalls.

18. The protective glove of claim 13, wherein said plurality of strips are attached to both said outer surface of said inner glove layer and said inner surface of said outer glove layer, said plurality of strips securing said inner glove layer and said outer glove layer.

* * * * *